US005501066A

United States Patent [19]

Errasti Iriarte et al.

[11] Patent Number: 5,501,066

[45] Date of Patent: Mar. 26, 1996

[54] STRETCHABLE FILM TRAY WRAPPING MACHINE

[75] Inventors: Iosu Errasti Iriarte; Ignacio Aguirre Arregui, both of Oñate, Spain

[73] Assignee: ULMA, S. Coop. Ltda., Onate, Spain

[21] Appl. No.: 255,853

[22] Filed: Jun. 7, 1994

[30] Foreign Application Priority Data

| | | | |
|---|---|---|---|
| Jun. 11, 1993 | [ES] | Spain | 9301332 |
| Apr. 29, 1994 | [ES] | Spain | 9400912 |
| Apr. 29, 1994 | [ES] | Spain | 9400913 |

[51] Int. Cl.[6] ..... B65B 53/00

[52] U.S. Cl. ..... 53/556; 53/389.4; 53/168; 53/228; 53/221

[58] Field of Search ..... 53/556, 221, 222, 53/389.2, 389.4, 389.5, 168, 228, 229, 223

[56] References Cited

U.S. PATENT DOCUMENTS

| | | | |
|---|---|---|---|
| 3,086,336 | 4/1963 | Rausing et al. | 53/389.2 |
| 4,400,928 | 8/1983 | Watanabe | 53/168 |
| 4,513,558 | 4/1985 | Treiber | 53/556 |
| 4,548,024 | 10/1985 | Fine | 53/556 |
| 4,709,531 | 12/1987 | Denda | 53/556 |
| 4,748,800 | 6/1988 | Takamura | 53/556 |
| 5,115,620 | 5/1992 | Takamura | 53/389.2 |
| 5,205,104 | 4/1993 | Nakashima et al. | 53/389.2 |

FOREIGN PATENT DOCUMENTS

| | | |
|---|---|---|
| 8700493 | 2/1987 | Spain . |
| 9101848 | 6/1991 | Spain . |
| 9201865 | 9/1992 | Spain . |

*Primary Examiner*—John Sipos
*Assistant Examiner*—Gene L. Kim
*Attorney, Agent, or Firm*—Keck, Mahin & Cate

[57] ABSTRACT

The machine is provided to wrap with a film portion a tray containing food products, the trays being inserted through a side device (13) having weighing scales which trays can moreover be labelled. The film insertion and cutting means comprise a carrier (3) joined to a cam (9) which on turning causes the said carrier to move forwards and backwards, whereas the cutting device has a blade (12) mounted upon a support, which is also driven by the cam (9) in such a way that the carrier and blade movements are synchronised. The machine includes a weighing station located under the carrier, and an electric station with all the power and control means of the machine as such, moreover incorporating tray lifting means that allow the lift to be used to handle variously sized trays, automatically and without having to change parts or elements. The machine also has a film insertion system that allows the film roll to be used to be changed fully automatically, the system comprising a frame driven by an eccentric, the former moving vertically in functional combination with a pair of film insertion carriers, by coupling to a drive carrier that is transversely displaceable by tightening means associated to the actual film cutting synchrony cam, the film insertion carrier to be used being selected by means of a number of locking and drive bolts that involve each of the carriers depending upon their relative positions to the drive carrier.

12 Claims, 11 Drawing Sheets

STRETCHABLE FILM TRAY WRAPPING MACHINE

OBJECT OF THE INVENTION

The invention relates to a stretchable film tray wrapping machine and in particular to a number of improvements to machines designed to wrap trays holding food products with a stretchable film, the subject machine being designed to optionally carry a weighing station and even a labelling station.

One of the improvements the machine includes is the provision of film insertion means and synchronism thereof with the cutting means, the above in order for the film replacement operation to be much easier.

Another improvement lies in the tray feeding means which have been designed to be optionally fitted with a weighing station or scales, organising feeding and weighing so that whilst a tray is being weighed another tray can already be disposed at the feeder load area.

Another improvement of the machine subject hereof is found in the electric station fitted with the cards and all components for controlling the machine, which station has been organised to be easily removable and replaceable if it breaks down. Another feature lies in that after loosening the screws holding it against the body of the machine, it will lie in a stable angled position that will make visual check and manipulation easier.

Another improvement of the machine lies in tray lifting means that allow the lifting means to be used to handle variously sized trays automatically and without having to change any parts or elements, covering almost all the usual marketable sizes.

Another improvement lies in that the machine is alternatively provided with mechanical insertion means which will, depending upon the size of the product to be wrapped, automatically change the film roll to be used.

BACKGROUND OF THE INVENTION

Utility model 9101848 of the same applicant claims a device for holding the film sideways in wrapping machines, which holding device relies upon a pair of clamps with which the film is held, which clamps are mounted upon supports travelling along tracks that allow the distance between the same to be varied, thereby adjusting perfectly to the type of roll to be used in each case, which adjustment is made fully automatically because of the mobility of the supports to which the film clamps are attached, and of the means working with such supports, such as racks, driving gears and so forth.

For its part, patent of invention 9201865, likewise of the same applicant, claims improvements precisely to film wrapping machines, applicable in means designed to control the reciprocating travel of a rod which limits the length of the film sector to be used to wrap each product or article, the above in order to have the film sheared at the specific length to be used for wrapping purposes.

Neither of the above devices has means enabling the film replacement operation to be controlled, nor are they fitted with means for weighing the wrapped products, specifically the trays containing such products and wrapped with the film as such.

Furthermore, known machines are constructed in such a way that it is if not impossible very difficult to be able to carry out overhauls and manipulations required to maintain machines of this kind.

Reference might also be made to Spanish patent of invention number 8700493 which also deals with a machine of the subject type, which includes a lifting arm, where the said lifting arm is appropriate only for certain tray sizes, and cannot handle larger sizes and hence does not allow the machine to be fitted with an automatic system for changing the size of the tray to be wrapped.

None of the above machines have automatic film replacement means when the size of the product to be wrapped is changed, nor indeed means allowing merely the initial assembly of the film or replacement thereof when a roll is used up and replaced with another.

DESCRIPTION OF THE INVENTION

The layout of the machine subject hereof relies on a general framework comprising a robust base joined to two front and rear plates, fitted with a number of crossbars. This general framework carries the elements making up the main parts of the machine and in particular the roll supporting means, film insertion and cutting means, wrapping means, film conveyor belt means, electric station, tray feeding means and control panel.

Roll supporting means

Two easily accessible roll supporting means with simple roll replacement are arranged on the left-hand side of the machine, one for each of the two different film sizes.

Film insertion and cutting means

These means deal with preparing a film sheet of set length, used to wrap the tray.

One of the improvements of the invention lies precisely in these means, which comprise a mechanical assembly driven by a motor, which is able to place the film, cut to a set length, between the film conveyor belt means.

The film insertion means comprise a carrier moving along a pair of tracks, which carrier consists of two parts hinged to one another, the lower part travelling along the said tracks and the top part, hinged at one end, being liftable to expedite the film replacement operation. Both the lower and the top hinged parts have a front comb and flexible rollers holding the film.

The carrier is connected to tightening means which are respectively connected to a cam that turns causing the same first to move forwards and then backwards. The said cam is on a different path associated to the film cutting blade, and the carrier movement is therefore synchronised with the blade movement in order for the film to be cut at the right time.

The cam is turned by an electric motor which first moves the lower shaft driving the film conveyor belt means and then the shaft upon which the cam is mounted is driven through gear and chain transmission.

Now therefore, when the cam turns it first causes the carrier to move forwards until the combs position the film end between the film conveyor belt means. To this end, in synchrony with such forward movement, a pair of small cams attached to the lower shaft of the drive belt means lifts the overhead shaft carrying the supplementary drive belts sufficiently to allow the combs to be placed between both shafts and hence between both belts, and hencec when the said cams are no longer operative, the drive belt means shall clamp the film end through the comb spaces and transfer the same, now cut, to the wrapping station.

Once the film has been clamped by the conveyor belt means the cam continues to turn and the carrier hence moves back. The belts take a set film length, each turning in the opposite direction. Having reached the set film length, the conveyor belts stop moving, and the cam then arrives at the cutting position and the blade makes a quick upward and downward movement, making the cut.

The film insertion carrier is always at the rearmost position at the time of cutting and the blade is always at a lowermost position when the inserting means insert the film between the drive belts, thereby ensuring that the operations are all reliable.

This system are convenient in that the film is at all times installed outside the conveyor belt means, and the film width change can be made in the machine, without removing the film from the inserting means.

Wrapping means

Such comprise lifting means and three folding means wrapping the tray with synchronised movements.

Film conveyor belt means

This is the means for transporting and placing the film sheet duly centered for wrapping purposes. It has electrically operated brakes to control the wrapping tension.

Electric station and cabling

The machine cabling is designed as two wholly independent circuits: control circuit and power circuit.

The power circuit has two cables required to drive the motors and electromagnets in the machine. The control circuit makes the proximity detector signals, photocells and security micros reach the system control card.

The sets of cables are all connected to the electric station by means of connectors, in order for the station to be removable from the machine and hence expedite its replacement if it breaks down.

The station is physically designed with two compartments separated by a metallic partition, one of which will house the control card with the power supplies and the other the power card. The station is supported by a metal bar that is mounted upon pins with the centre of gravity offset, and hence upon loosening the screws holding it to the body, it shall swing 30° outwards of the machine, thereby enabling access to its components.

Tray feeding means

Such comprise a frame firmly held to the front plate of the machine. A motor drives two conveyor belt means, which are designed to transfer the trays from the loading position to the weighing position and from the latter into the machine for wrapping purposes.

One of the characteristics of the invention is to provide the position of the weighing means halfway between the loading area and the window leading into the wrapping means. Thus, while one of the trays is being weighed, another tray can be laid at the loading area, enhancing the rate of work over other known systems, in which the weighing station is positioned right at the loading area, thereby precluding the possibility of placing another tray until the previous tray has been weighed and then moved into the wrapping area.

The feeding means are completed with driving means activating the detector which starts the drive motor, which motor will stop when the drive cue reaches the position of an optical sensor.

The weighing means are located below the feeding carrier and halfway and preferably as close as possible to the front plate of the machine. This weighing station is fitted with four rods passing through the plate constituting the framework of the feeding means through slots designed for the said rods not at any time to touch the feeding carrier. The rods are designed to transmit the weight of the trays to the scales.

The tray is transferred from the loading position to the weighing position and, when the belts arrive at the weighing position, they move counter to the forward direction in order to release contact of the drive cues with the tray for weighing to be accurate.

The provision of the weighing station is optional and can indeed if fitted be cancelled when the feeding means as such are to work alone.

Control panel

Such has a keyboard to program wrapping as required by the user and a display showing the alarm and other parameters.

The machine is also provided with improvements provided in the said film insertion means, designed to allow the film roll replacement operations fully automatically to adjust to the different sizes of the products to be wrapped. In order to achieve the said objectives, the use of two roll supporting means is provided, one for each film roll, and two film feeding carriers having flexible rollers to hold the film, and the required combs to feed the same between the drive belts, the film feeding carrier moving alone at all times as required for the kind of roll required for wrapping purposes, the movement being caused by tightening means, connected to a cam, in such a way that on turning, the same cam causes the relevant carrier to move forwards and backwards. The said cam is precisely used to synchronise the film cutting movements at the required length.

In order to select the film insertion carrier to be used, holding and guiding means are provided comprising a pair of bolts fixed to the frame and lying facing or otherwise two slots existing in the insertion carriers, in such a way that one is free and the other is held still by the action of the bolt in the relevant slot. To this end, a second cam is provided, moving the assembly formed by the two guiding carriers upwards, leaving the carrier with the film that is not to be used, facing one of the fixed bolts, and held still, whereas the carrier supporting the film to be used is free to be guided up to the drive rollers. This movement takes place driven by the cutting synchronism cam, which transmits its movement to a drive carrier and the latter, through a top bolt fitting in a slot in one of the movable carriers, drives the same on moving. Selection of the carrier to drive takes place just as described for retention, viz. by action of the vertically displaceable cam.

Movement of this second cam must be associated to that of the film cutting cam to guarantee synchronism of all the operations described with the cutting and driving operations.

Moreover, as two roll supporting means are provided, one for each film roll, the above operation requires both to have the film assembled before being used, to which end a simple device has been provided to expedite initial film assembly, comprising an elastic band placed between two rollers to allow the end of the film roll to be inserted between the rollers holding the film and then the arrangement thereof in the insertion comb.

It shall have become clear that, in accordance with the latter improvements, once the film sheets are fitted in the carriers inserting the film, it is sufficient to synchronise the cam movements with the film roll change situations in order for such change to be automatic, thereby eliminating the waiting time required for a manual change, with the resulting improvement as regards autonomy and productivity of the wrapping machine as a whole.

Another improvement lies in that on either side of the main arm or tray lifting means, and parallel to the same, two auxiliary arms are provided, coupled to the hinge axis on the main arm and carrying a number of tray supporting means, surrounding the tray supporting plate on the main arm, conforming an outer extension thereof upon which larger sized trays can be supported, the latter being fully supported by the supporting surface conformed thus.

In order to ensure that both the surface of the main support and the additional external surfaces are displaced simultaneously and in synchrony, avoiding imbalances in the tray supported upon the same, coupling means are provided between both arms, causing the main arm to drive in moving upwards the auxiliary arm, thereby moving as if only one arm.

The coupling means comprise a rod driven by an electromagnet, the means being located on the auxiliary arm, being insertable in a hole especially provided on the main arm.

With this device it is not only possible to handle different tray sizes with the same machine, but moreover to automatically wrap products included in variously sized trays, for the means provided to work with one size or another of trays are mounted permanently in the machine, and it suffices merely to enable or disable the use of the means required for each operation.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figure 1:
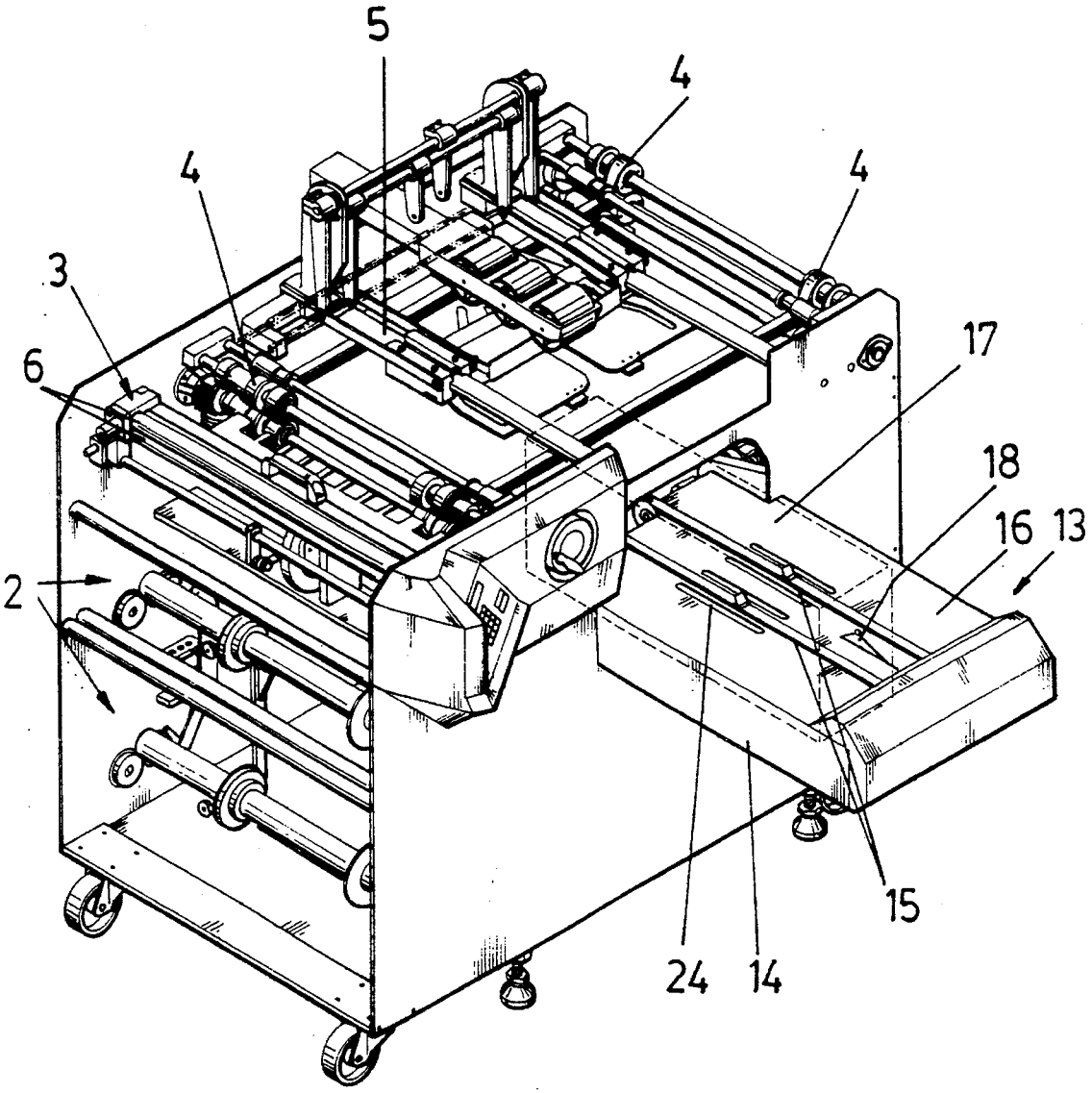
FIG. 1 is a general perspective representation of the stretchable film tray wrapping machine made in accordance with the object of the invention.
Figure 2:
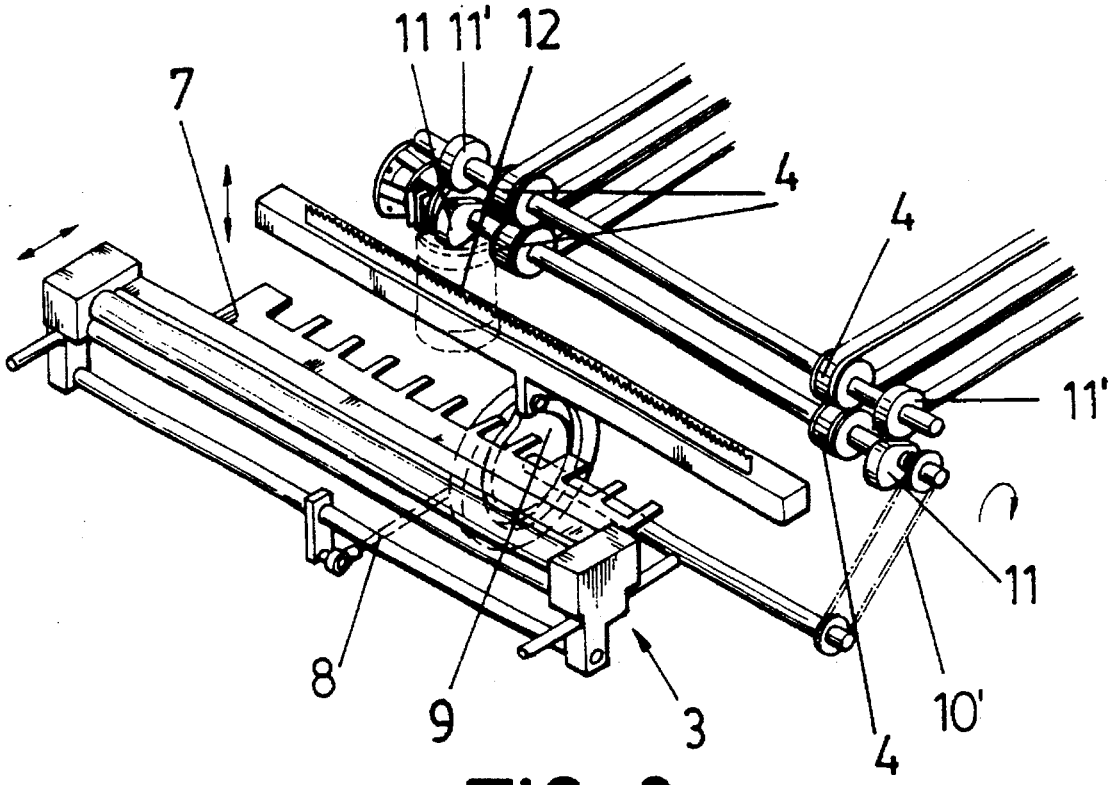
FIG. 2 is a perspective close view of the film insertion and cutting means.
Figure 3:
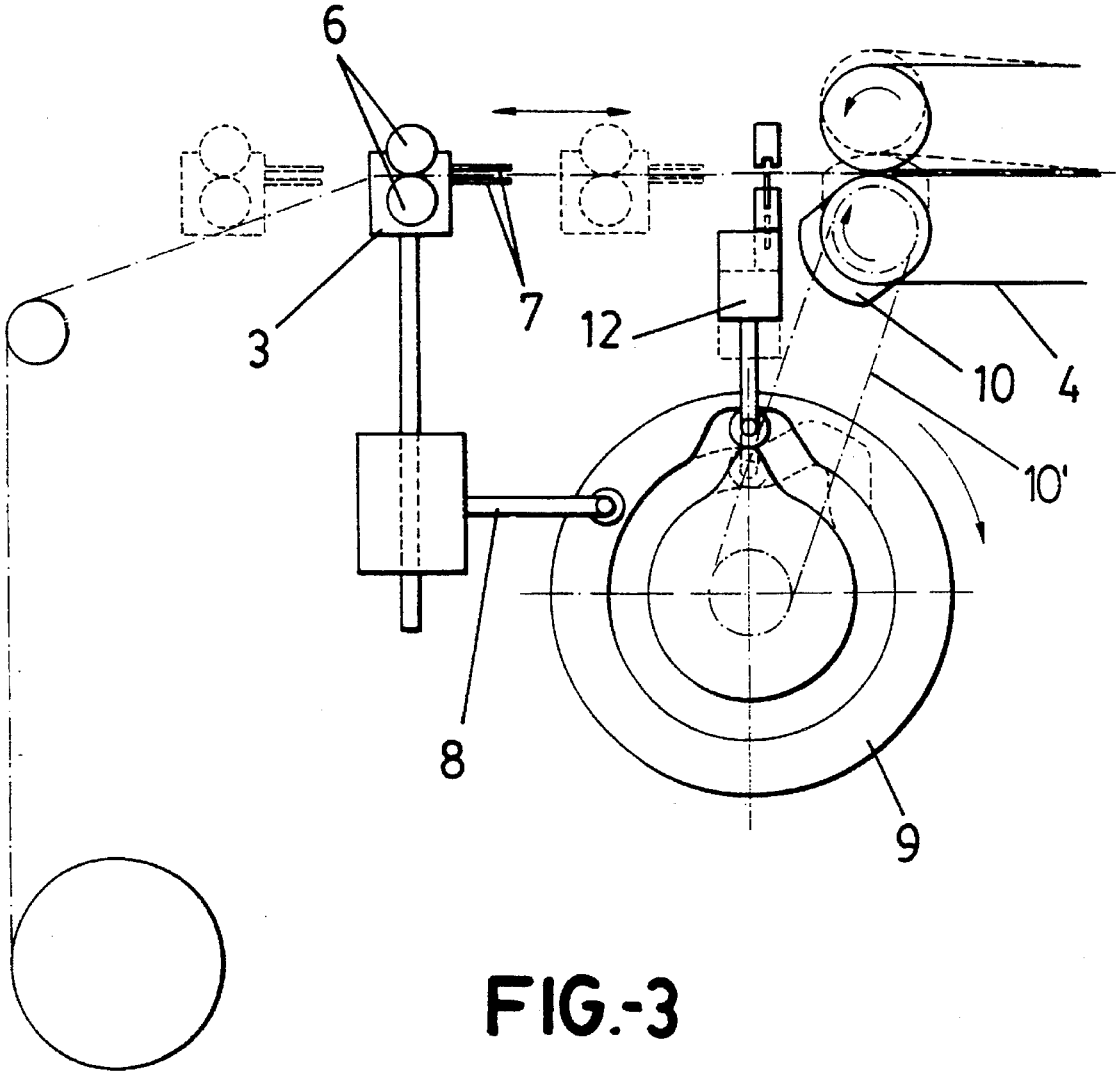
FIG. 3 is a schematic representation of what can be considered to be a side elevation of the film insertion and cutting means of the previous figure.
Figure 4:
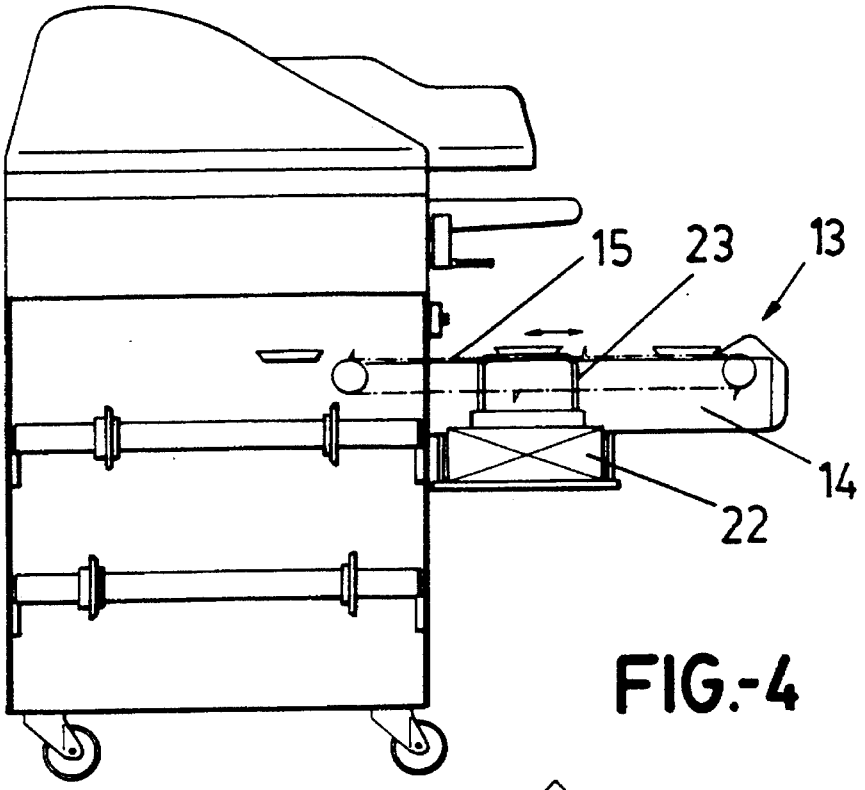
FIG. 4 is a side elevation schematic view of the wrapping machine, showing the feeding means and weighing station arranged under the same.
Figure 5:
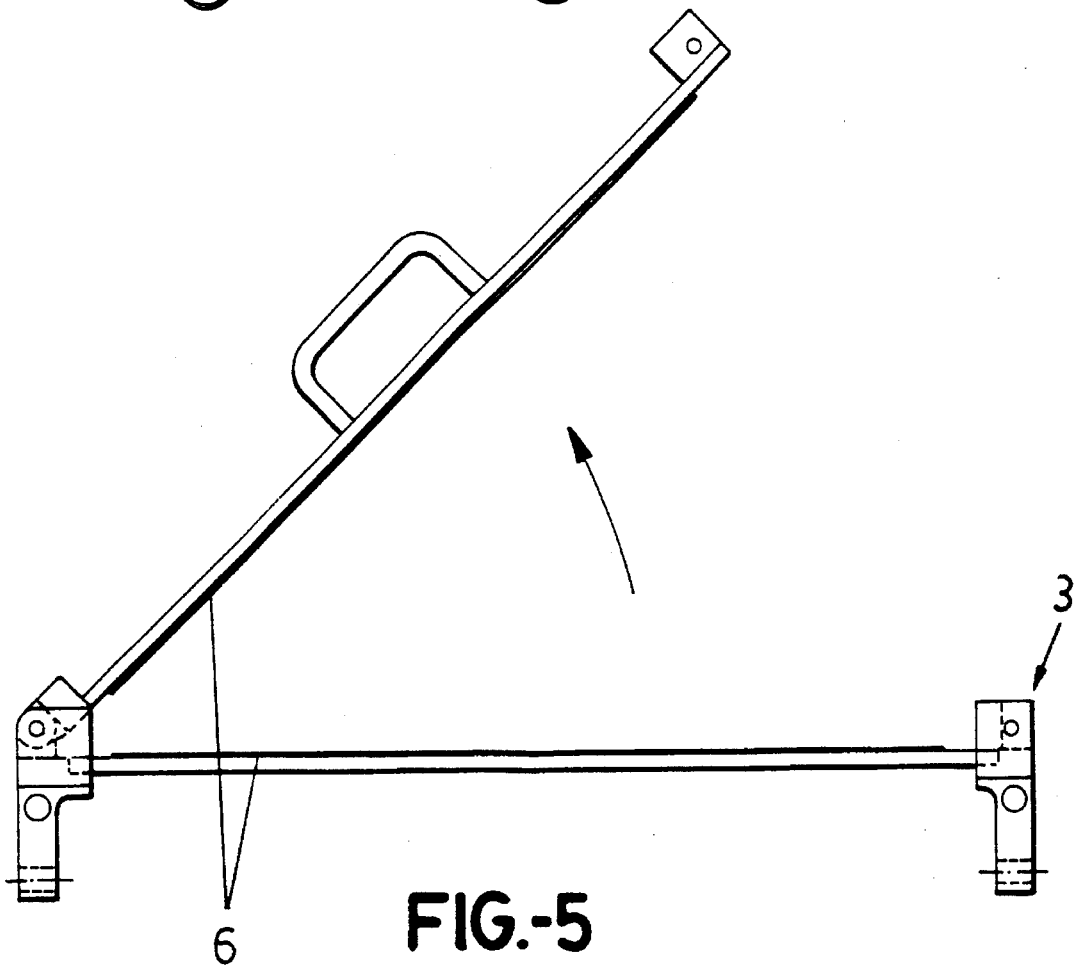
FIG. 5 is a front and open view of the two parts making up the film insertion carrier without showing the flexible cylinders holding the film, one attached to the top collapsible part and the other to the lower fixed part.
Figure 6:
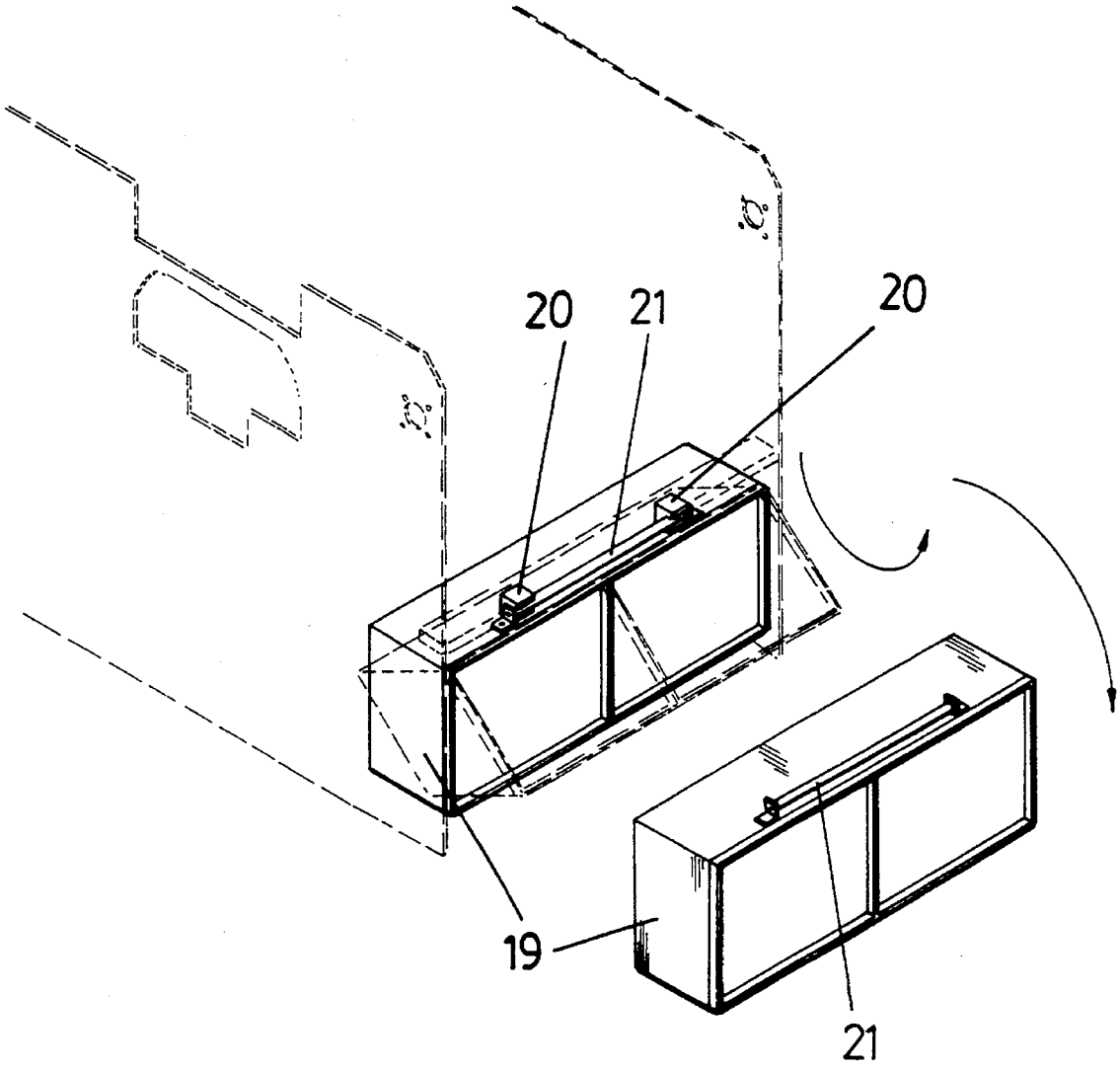
FIG. 6 shows the right-hand side of the machine in which the electric station is provided, showing the angled position the station adopts upon detachment of the screws holding it to the framework of the machine.
Figure 7:
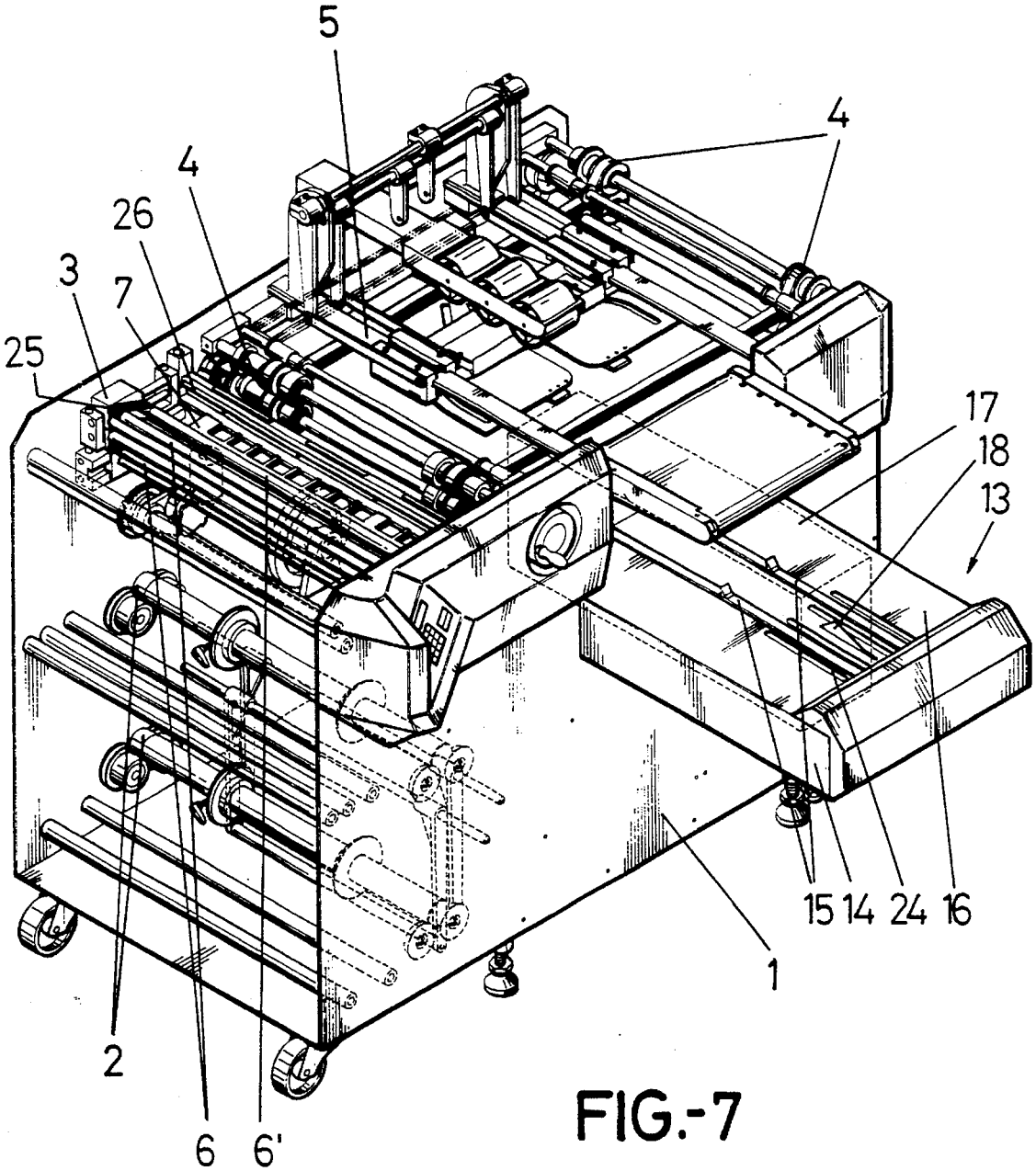
FIG. 7 is a general perspective representation of a machine similar to the machine of FIG. 1, this FIG. 7 having the film insertion means to automatically change the film roll to be used.
Figure 8:
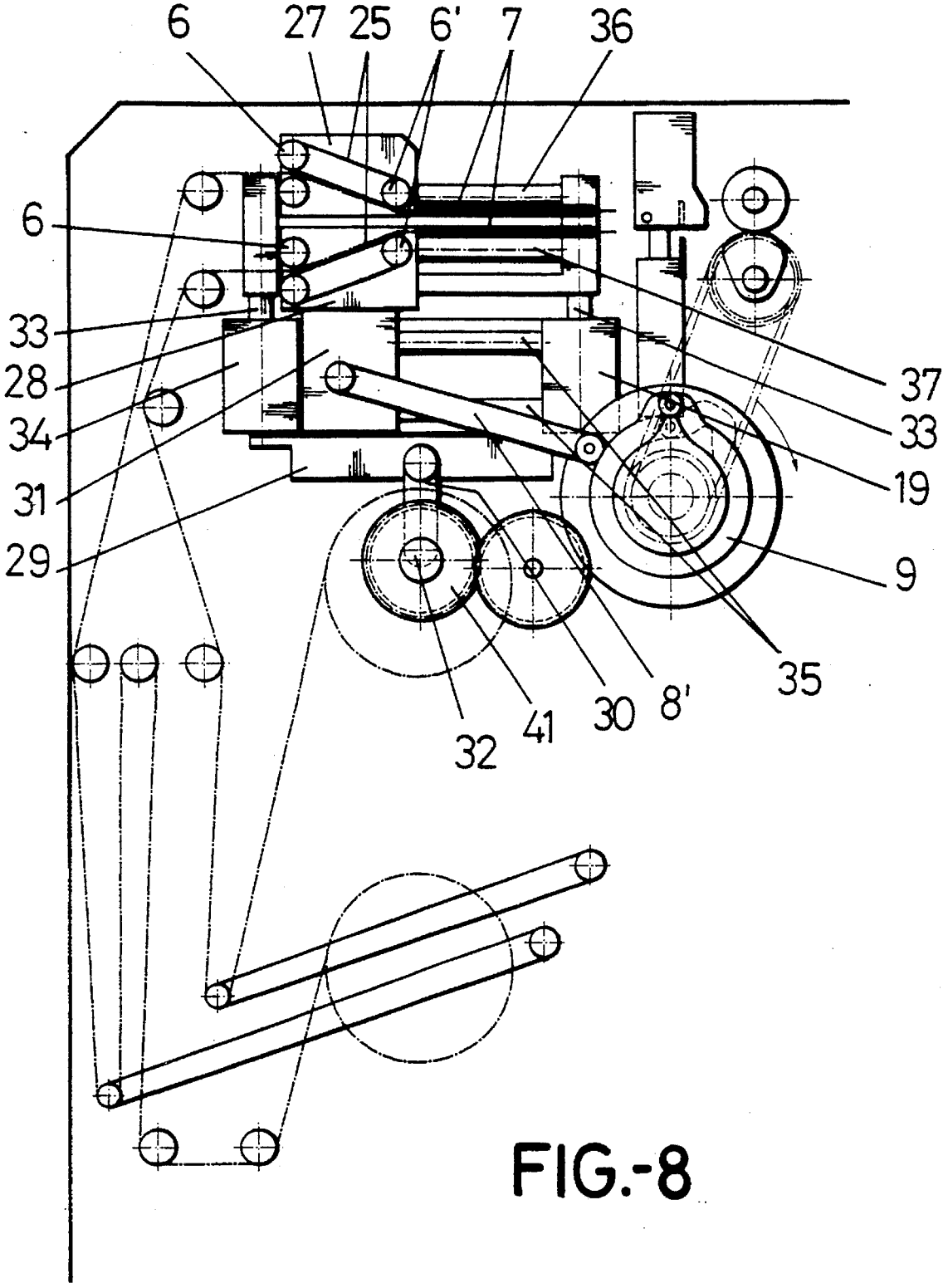
FIG. 8 shows a profile view of the entire automatic film changing means of the previous figure.
Figure 10:
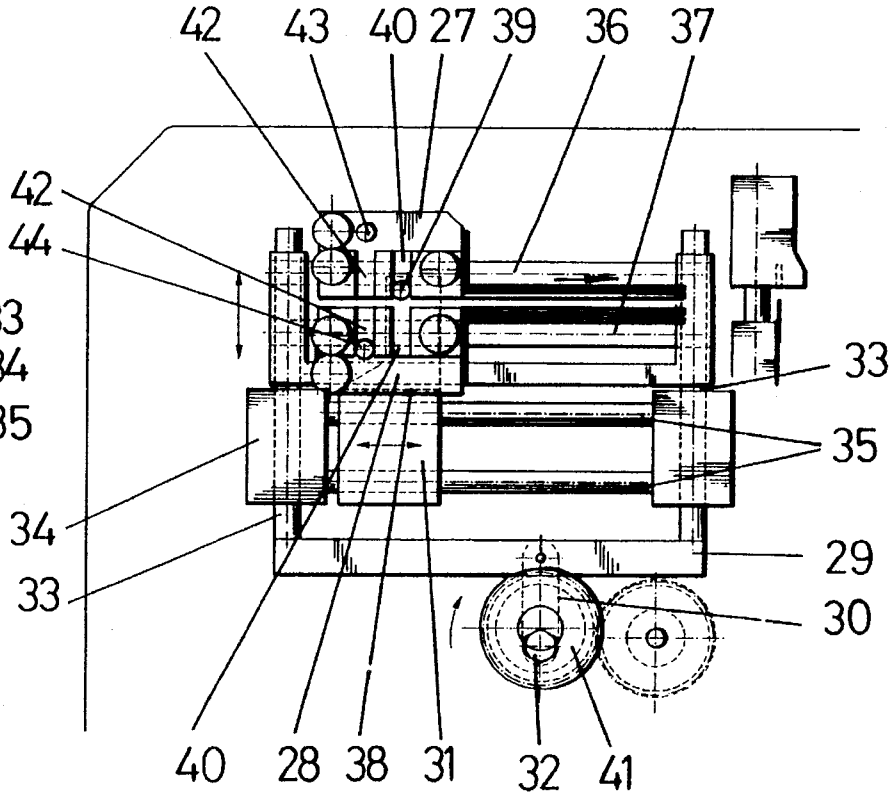
FIG. 10 shows the same view of the previous figure, with the means in the position in which the top film roll is driven.
Figure 9:
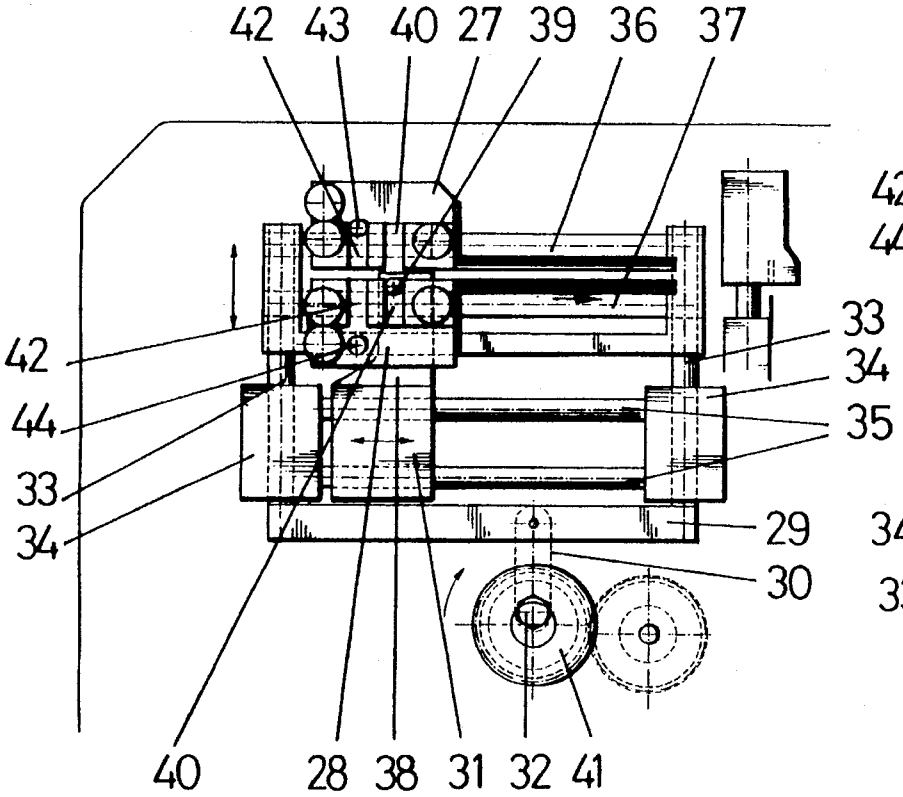
FIG. 9 shows a profile view of the automatic changing means shown in the above two figures, in a position in which the lower film roll is driven.

As shown in the figures, the machine of the invention comprises a structure or framework (1) consisting of a base and two front and rear plates, between which various elements and means are arranged crosswise structurally and functionally completing the machine. Noteworthy among these are the roll supporting means (2), which allow the use of rolls of various widths. Over the roll supporting means there is a film insertion carrier, numbered (3), and in front of such carrier the drive or conveyor belt means (4) and then the wrapping means (5) for the food carrier trays.

The film insertion and cutting means include a carrier (3) fitted with a pair of rollers (6) holding the film and a pair of combs (7). The top roller can swing with part of the carrier and hence when changing rolls the roll end can be easily arranged between the holding rollers (6) and the insertion combs (7).

The carrier thus constructed is connected to tightening means (8) respectively associated to the cam (9). Turning of the cam first causes the carrier (3) to move forward until the combs (7) inserting the film lie between the drive belts (4) to which end at the forwardmost position of the combs (7) a pair of small cams (11) mounted upon the shaft of the lower conveyor belt means, with the assistance of sheaves (11') mounted upon the shaft of the top conveyor belt means, cause the latter to be lifted slightly, thereby allowing the combs (7) to be arranged between both conveyor belt means, and hence, when the action of the small cams (11) ceases and the top shaft returns to its usual position, the conveyor belt means clamp the film through the relevant comb spaces.

In synchrony with film clamping by the conveyor belt means (4) the cam (9) continues to turn causing the carrier (3) to move back or return to its initial position, now driven by the tightening means (8), the conveyor belt means (4) drive the set film length, each turning in the opposite direction, at which time they stop and the blade (12) operates likewise driven by the cam (9) that will at that time be at the cutting position and cause a rapid upward and downward movement of the blade.

The cam (9) is driven by an electric motor (10) through a gear-chain transmission (10') provided on the lower front shaft of the drive belts (4) and the actual cam shaft.

It should be noted, as aforesaid, that it is in practice very convenient for the feeder to be always at the rearmost position when cutting takes place, and further for the blade (12) to be always at the lowermost position when the insertion means are operating.

The front panel of the machine carries the tray feeding means (13) which comprise a frame (14) and a motor (not shown) moving two conveyor belt means (15) transferring the trays from the loading position (16) to the scales position (17) and from the latter into the machine, to be wrapped.

The trays are arranged on driving means (18) that activate a detector which in turn sends a signal to the control that will start the motor. The motor will stop when the drive cue with which the conveyor belt means (15) are provided reaches the position of an optical sensor, all being conventional and not shown.

Beneath the tray feeding means and as close as possible to the front plate supporting the insertion means, there are scales or weighing means (22). The weight of the tray is transmitted to the scales through four rods (23) projecting through slots (24) designed for the rods not to touch the feeding carrier at any time.

When the tray reaches the scales position (17) the belts move counter to the forward direction in order to release contact of the drive cues with the tray, and for weighing to be accurate.

It should be noted that it is convenient to have provided the location of the scales between the load or supplying area and the entrance to the machine and, preferably as close as possible to the access to the machine. Thus, while one tray is being weighed, another can be arranged in the supply area.

Finally, the machine has an electric station (19) located on the right-hand side and having a bar (21) located at the front area of its top base, being suspended from this bar as the latter is mounted on two supports (20) attached to a crossbar arranged between both panels of the framework. The assembled station is joined to the side panels by screws (not shown). Now then, it so happens that on loosening the screws the station swings by displacement of the centre of gravity and projects in part to the outside in an inclined position, which position favours viewing of its components and manipulation thereof. It should in any event be noted that since the station incorporates all the power and control means, if it breaks down it can be replaced in block by another, thereby avoiding stoppage working time of the machine whilst the breakdown is located and repaired.

In a different embodiment, or in other words, an improvement of the machine described, the machine carries automatic roll replacement means which are firstly provided with means for initially mounting the film comprising, for each roll, a band (25) located on the left-hand side of the insertion means (3), which band (25) clamps the top holding roll (6) and an auxiliary roll (6') in order that, acting manually upon the said band (25), the band transmits a turning movement to the respective roller (6) such that, inserting a film end of one of the insertion rolls (2) between the rollers (6), the movement applied to each of these causes the film to pass between them and be arranged upon the comb (7) with the assistance of a turning rod (26) located before the drive belts (4), around which the film end is passed, the film being thus ready for product wrapping operations to commence. The operation described is carried out for each of the film rolls (2) and must first be carried out for the lower roll and then for the top roll, in order to allow a subsequent automatic change to take place correctly.

Furthermore, the machine, in the embodiment described and corresponding to FIGS. 7, 8, 9 and 10, includes two carriers (27) and (28) fitted with pairs of rollers (6) and the pair of combs (7) in such a way that depending upon the film roll (2) to be used, the film insertion operations shall use certain elements or their counterparts.

The full insertion system being described comprises a frame (29) movable vertically driven by a crossbar (30) moved by an eccentric (41) which on turning about the shaft (32) moves the said frame (29) upwards and downwards, depending upon whether the top (27) or lower (28) assembly is to be used. This frame (29) has two rods (33) at its ends sliding during its movement internally two blocks (34) fixed to the wall of the machine and between which there are two transverse tracks (35) that allow a drive carrier (36) to move, which is driven by tightening means (8') associated to the cam (9) for cutting synchrony, causing the said carrier (31) to move forwards or backwards until the film insertion combs (7) are located between the drive belts (4).

Depending upon the film roll to be used for wrapping purposes, the drive carrier (31) will be fixed to either of assemblies (27) or (28) and be driven with the respective film sheet by the said supporting carrier (31). These two assemblies (27) and (28) travel along two tracks (36) and (37) associated to the top part of the movable frame (29) and in turn transmitting to the supporting carriers or assemblies (27) and (28) the upward or downward movement of the frame (29). In order for automatic film change to take place, the assembly or carrier (27) or (28) to be fixed to the supporting carrier (31) to be displaced to the drive belts is automatically selected. The drive carrier (31) has to this end been provided to have a bolt (39) designed to be inserted in a vertical slot (40) of the carriers (27) and (28) arranged with its face looking onto the frame of the machine and that, being fixed to the carrier (31), can only move across, fitting into one of the said slots (40) depending upon the position taken by the carriers or assemblies (27) and (28) due to the cam movement (41), driving with it, by means of the said bolt (39), the carrier corresponding to the roll to be used.

Simultaneously to one of the carriers moving, the other carrier is held still, to which end the carriers or assemblies (27) and (28) have a second slot (42) which depending upon the vertical position of the carriers due to the movement transmitted by the cam (41) will lie facing the two bolts or otherwise, a top bolt (43) and a bottom bolt (44), fixed to the plate of the general frame of the machine, and which hold still one of the carriers at each of the cam (41) positions, the carrier being the one supporting the film roll that is not used at that time.

Thus, operation of the driving and holding means described will be as follows:

When the cam (41) is located at its uppermost position the frame (29) rises a respective distance, driving with it the carriers (27) and (28). At that time the top bolt (43) is fitted in the slot (42) of the top carrier (27), holding it still, and on the other hand the lower fixed bolt (44) is totally free. Simultaneously, the bolt (39) of the drive carrier (31) is fitted into the slot (40) of the lower carrier (28) driving such carrier, when the drive carrier (31) is involved in the transverse movement transmitted by the tightening means (8'), thus approaching the drive rollers (4).

The opposition situation comes about when the cam (41) is at the lowermost position and therefore so is the frame (29). At that time, the top bolt (43) is free and the lower bolt (44) fits into the slot (42) of the lower carrier, holding it still. In turn, the bolt (39) on the drive carrier (31) shall have fitted into the slot (40) of the top carrier (27) driving the same up to the drive rollers (4).

Figure 11:
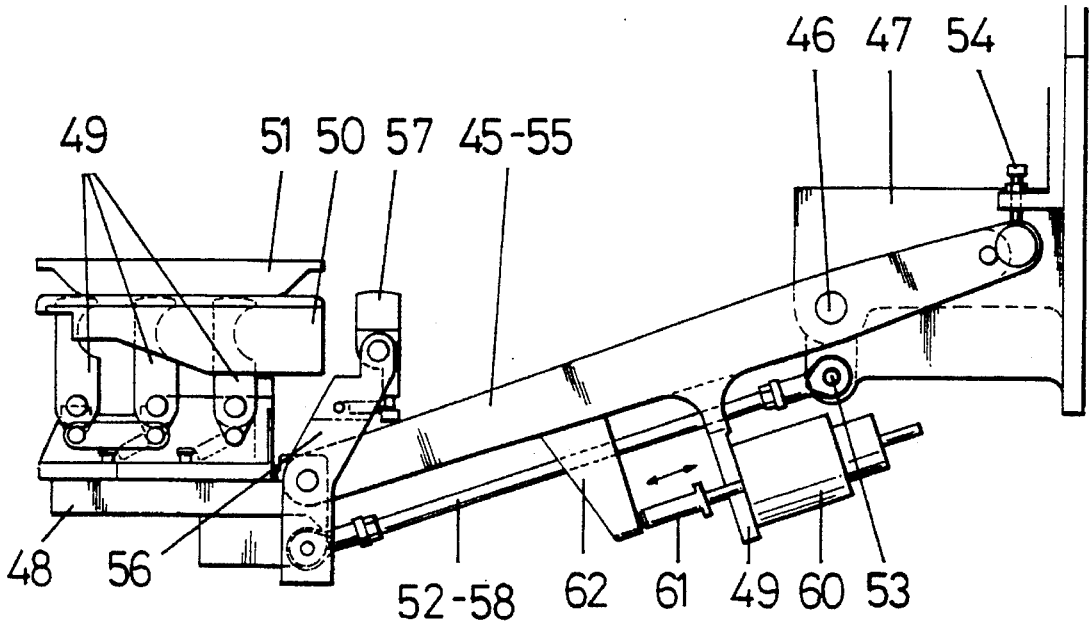
FIG. 11 shows a profile view of the tray lifting means, when at rest and provided to lift small trays.
Figure 11A:
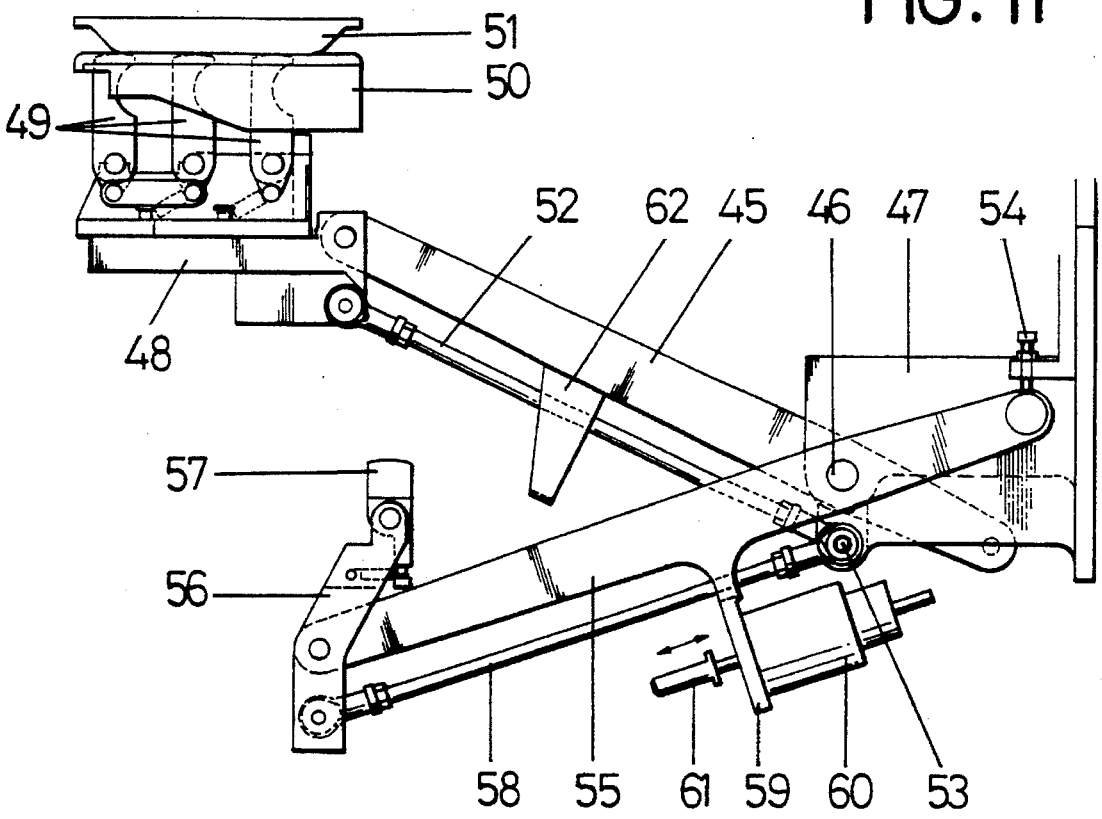
FIG. 11*a* shows a view similar to the above with the tray lifting means in action, keeping the auxiliary arms at rest.

On the other hand, FIGS. 11, 11*a*, 12, 12*a* and 13 hows respective views of the tray lifting arm, the whole system including a main arm (45) swinging about a shaft (46) relative to a fixed support (47). The said joint (46) lies close to one of the ends of the main arm (45) whereas the opposite end of the latter carries assembled a platform (48) supporting the jointed elements (49) and plates (50) holding the tray (51), which tray may be of a standard size as shown in FIGS. 11 and 11*a* or large as shown at (51') in FIGS. 12 and 12*a*. Parallel to the main arm (45) and at a lower position thereof, there is a rod (52) likewise jointed at its ends (53) defining with such arm (45) a jointed quadrilateral designed to prevent the platform (48) from swinging about the arm (45) and to ensure that the platform (48) is horizontal while the arm (45) is moving.

The support (47) has an abutment (54) with which the free end of the main arm (45) contacts when moving down, thus preventing the said arm on reaching its lowermost position from exceeding a fixed position preset by the position of such abutment (54).

This main arm (45) further has a pair of auxiliary arms (55) likewise swinging about the shaft (46), which arms (55) have one of their ends also provided to contact with the abutment (54) whereas the opposite or free end incorporates a support (56) for a top supporting element (57), being particular in that each pair of auxiliary arms (55) is provided, for stabilisation purposes, with a respective auxiliary bar (58), the latter being also jointed as the bar (52) on the main arm (45), as the figures clearly show.

Now then, these auxiliary arms (55) are provided with a transverse extension (59) having an electromagnet (60) fixed upon it which acts upon a rod (61) causing the same to move about an inner shaft and parallel to the relevant arm (55), which rod (61) is at its outermost position housed in a U-shaped extension (62) provided internally and in an intermediate position on the main arm (45), in such a way that when the rod (61) is inserted in the extension (62) the main arm (45) drives in moving the said rod (61) and with it the whole auxiliary arm (55).

Operation is as follows:

When at the lower position of the assembly, corresponding to the situation of rest shown in FIG. 11, a tray (51) of the small kind is to be wrapped, the electromagnet (60) does not act, and the rod (61) remains in its retracted position, whence the main arm (45) turns about the shaft (46) to reach the position corresponding to the tray wrapping operation, as shown in FIG. 11*a*, the auxiliary arm (55) remaining at the lowermost position supported against the abutment (54), taking no part in the wrapping operations.

Figure 12:
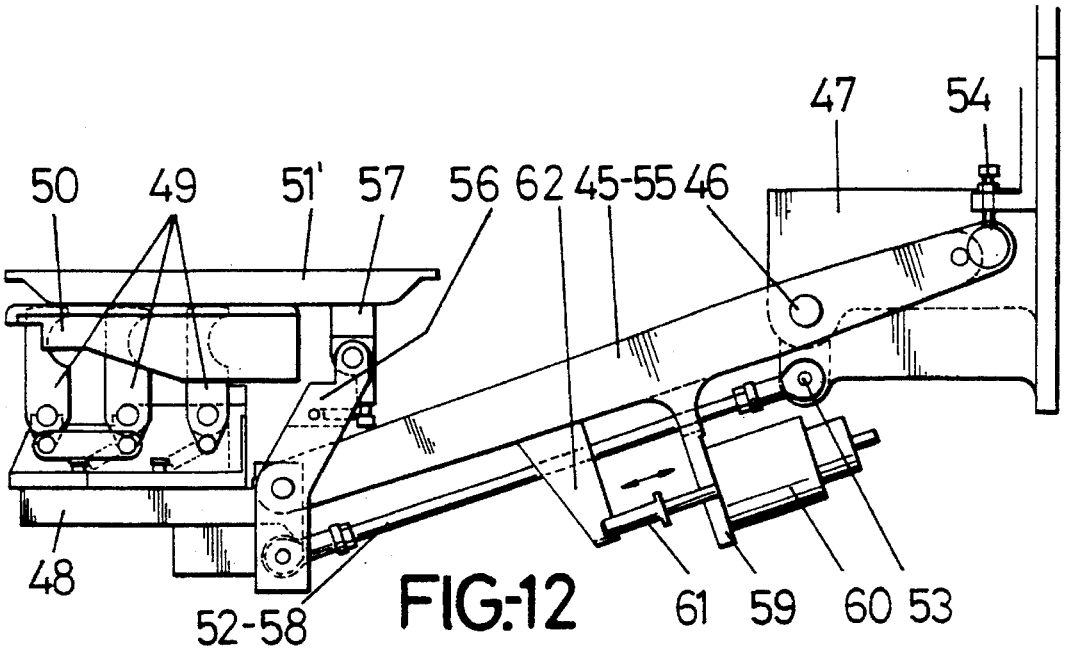
FIG. 12 shows a view as in the previous figure, but with the lifting means provided for large trays.
Figure 12A:
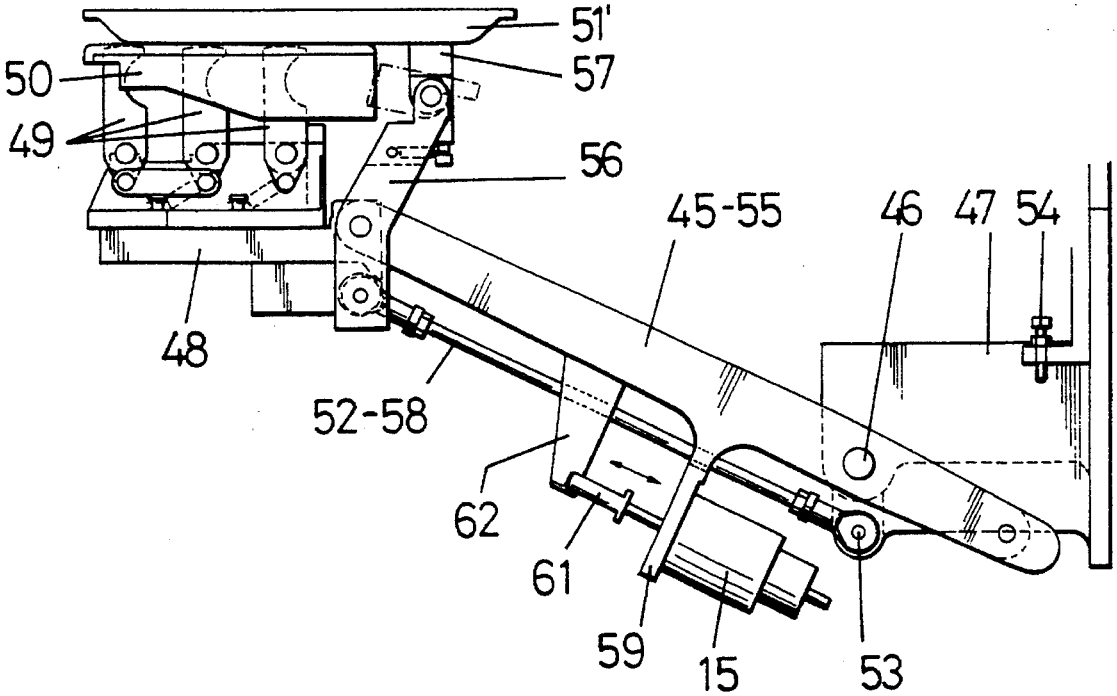
FIG. 12*a* shows a view of the lifting means shown in the previous figure, when in action, viz. lifting a large tray.

When, however, a tray (51') of the large kind is to be wrapped, the electromagnet (60) is activated causing the rod (61) to move to its outermost position, being housed in the cavity defined by the lower extension (62) of the main arm (45), in such a way that when the said main arm (45) turns to reach the tray wrapping position, this auxiliary arm (55), driven by the main arm, shall accompany the same to the said working position, as shown in FIGS. 12 and 12*a*.

Figure 13:
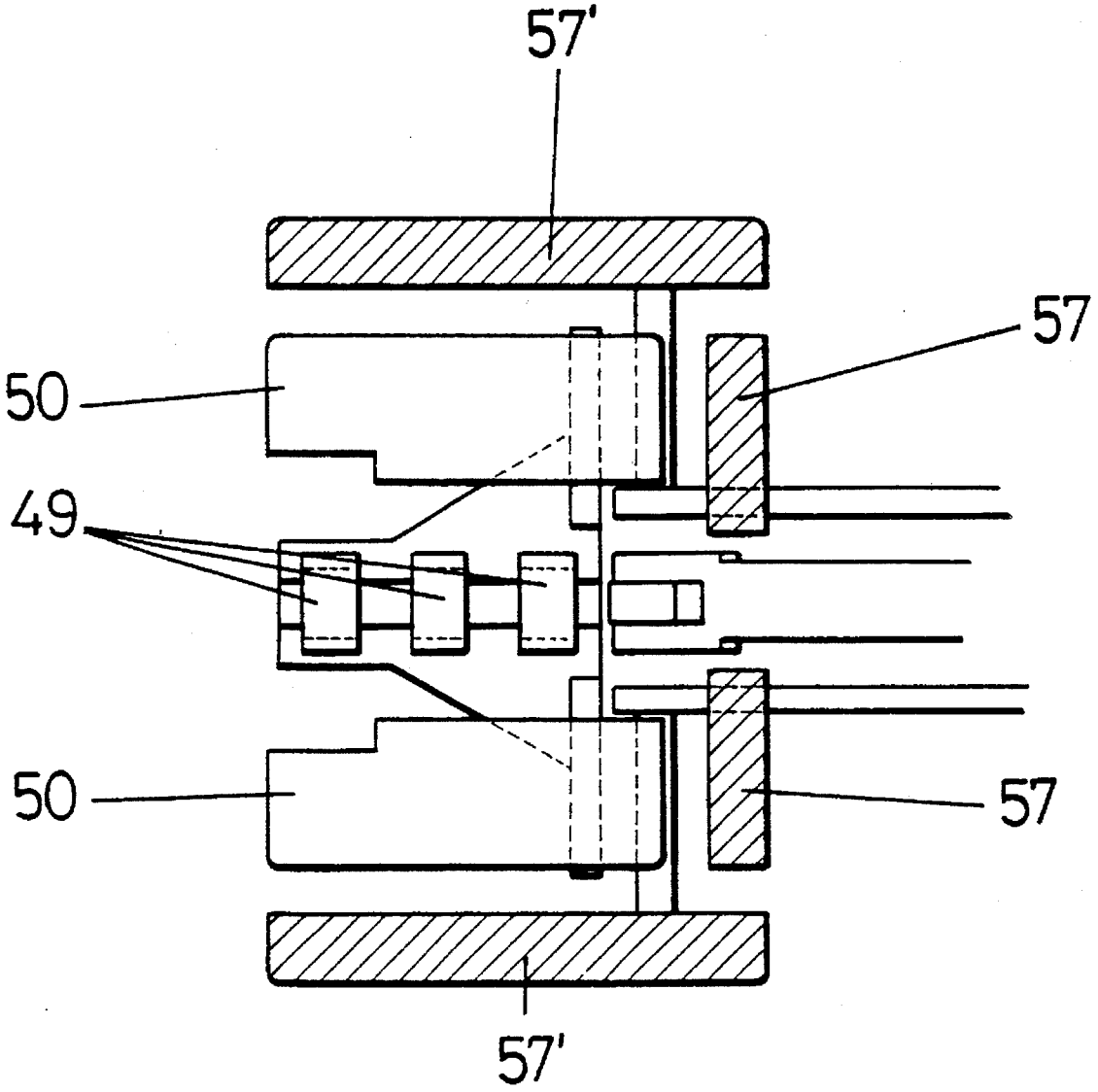
FIG. 13*a* Finally shows a schematic plan view of the lifting means shown in the previous figures, with the elements fitted to handle the large trays visible.

Finally, FIG. 13 shows that each auxiliary arm (55) can incorporate a small transverse support (57) and a larger longitudinal support (57') in such a way that the four supports together conform a full extension of the main supports (50) corresponding to the small trays, thereby to conform a supporting surface for the large trays entirely.

We claim:

1. A stretchable film tray wrapping machine, comprising roll supporting means (2), film insertion and cutting means, drive belt means (4) for horizontally feeding the film, a wrapping station (5), feeding means (13) for trays to be wrapped with the film, and lifting means including a main swinging arm and a rod forming a jointed quadrilateral with the arm, wherein the film insertion and cutting means comprises a horizontally moving carrier (3) having respective combs (7) to move forward and insert the film between the drive belt means (4) comprising top and bottom drive belts, which carrier (3) is joined to a cam (9) through tightening means (8) so that when the cam turns the carrier (3) is caused to move forwards and backwards, said cam having associated, on a different cam profile, a vertically moveable film cutting blade support (12), movement of the carrier being in synchrony with movement of a blade, in order that when the blade acts upon the film, the carrier is at a rearmost position and when the carrier moves forward, the blade is always at a lowermost position, wherein the insertion combs (7) are inserted between said top and bottom drive belts of drive belt means (4) which has upper and lower shafts, said lower shaft is fitted with a pair of cams (11) which, act upon sheaves (11') on said upper shaft to cause the lower shaft to be lifted slightly and later to recover when the said cams stop acting.

2. A stretchable film tray wrapping machine, comprising roll supporting means (2), film insertion and cutting means, drive belt means (4) for horizontally feeding the film, a wrapping station (5), feeding means (13) for trays to be wrapped with the film, and lifting means including a main swinging arm and a rod forming a jointed quadrilateral with the arm, wherein the film insertion and cutting means comprises a horizontally moving carrier (3) having respective combs (7) to move forward and insert the film between the drive belt means (4), which carrier (3) is joined to a first cam (9) through first tightening means (8) so that when the cam turns the carrier (3) is caused to move forwards and backwards, said cam having associated, on a different cam profile, a vertically moveable film cutting blade support (12), movement of the carrier being in synchrony with movement of a blade, in order that when the blade acts upon the film, the carrier is at a rearmost position and when the carrier moves forward, the blade is always at a lowermost position, wherein the film insertion means comprises a frame (29) activated by a second cam (41) to move vertically, a top part of said frame (29) having two tracks (36) (37) for lateral movement of two film insertion carriers (27) (28) that are coupled to a drive carrier (31) that moves laterally by action of a second tightening means (8'), the second tightening means works in synchronous motion with the first cam for film cutting and the second tightening means moves laterally in the two tracks which are held by two blocks fixed to a general frame of the machine.

3. A stretchable film tray wrapping machine, as in claim 2, wherein the drive carrier (31) incorporates on a top end thereof a bolt (39) housed in a groove (40) of one of the film insertion carriers (27), (28), depending upon a relative position of the said drive carrier (31) to the said carriers (27) and (28), such relative position being caused by lifting or lowering thereof, due to movement of the cam (41).

4. A stretchable film tray wrapping machine, as in claim 2, wherein the drive carrier (31), in moving transversely, driven by the tightening means (8') and guided by the tracks (35), drives by action of a bolt (39) one of the two film insertion carriers (27), (28) until a respective comb (7) is located within the drive belt means (4).

5. A stretchable film tray wrapping machine, as in claim 2, wherein two bolts are fixed to a plate of the general frame of the machine, an upper bolt (43) and a lower bolt (44), one of which is constantly facing a slot (42) and housed within said slot (42) for fixing either film insertion carrier (27) or (28), whereas the other said bolt is free.

6. A stretchable film tray wrapping machine, as in claim 2, wherein a fixed bolt (43) or (44) is housed in a slot (42) corresponding to film insertion carrier (27) or (28) which is not being used in the subsequent wrapping operation, holding the said carrier stationary and preventing the said carrier from moving up to the drive belt means.

7. A stretchable film tray wrapping machine, as in claim 2, wherein the drive carrier (31), on moving transversely, drives one of the film insertion carriers (27) or (28) by a synchronized action of a said carrier lifting and selecting the cam (41) and the film cutting cam (9).

8. A stretchable film tray wrapping machine, as in claim 2, wherein one of the film insertion carriers (27) and (28) incorporates a band (25) coupled between a top holding roller (6) and an auxiliary roller (6') transmitting to the said rollers a turning movement, when the band (25) is activated manually, allowing a film end to be inserted between the holding rollers, causing the film end to reach a turning rod (26) about which the said film is rolled and being arranged on the respective comb (7).

9. A stretchable film tray wrapping machine, comprising roll supporting means (2), film insertion and cutting means, drive belt means (4) for the film, a wrapping station (5), feeding means (13) for trays to be wrapped with the film, and lifting means including a main swinging arm and a rod forming a jointed quadrilateral with the arm, wherein wherein the film insertion and cutting means comprises a carrier (3) having respective combs (7) to insert the film between the drive belt means (4), which carrier (3) is joined to a cam (9) through tightening means (8) so that when the cam turns the carrier (3) is caused to move forwards and backwards, said cam having associated, on a different cam profile, a film cutting blade support (12), movement of the carrier being in synchrony with movement of a blade, in order that when the blade acts upon the carrier, the carrier is at a rearmost position and when the carrier moves forward, the blade is always at a lowermost position, wherein the lifting means, in addition to the main arm (45) and the rod (52), swinging and mounted to define a jointed quadrilateral, is provided with a pair of auxiliary arms (55), with corresponding auxiliary rods (58), associated, in each case, to a said auxiliary arm (55) and coupled, as the main arm (45) and its rod (52) to a fixed support (47) through a common joint (46), a free end of said auxiliary arms (55) having a support (56) fitted with a support (57) that is held vertically throughout the movement of the respective auxiliary arm (55).

10. A stretchable film tray wrapping machine, as in claim 9, wherein each support (56) provided at a free end of each auxiliary arm (55) is fitted on a top end thereof with the respective support (57) crosswise and a longitudinal support (57'), which supports surround supporting plates (50) on the main arm (45), conforming an extended supporting surface, suitable to house trays (51') which are larger than small or conventional trays (51).

11. A stretchable film tray wrapping machine, as in claim 10, wherein the auxiliary arm (55) incorporates a transverse extension (59) holding an electromagnet for moving a rod (61), drawing it away from or towards the said transverse extension (59), being housed in the first case in a hole or box provided to said transverse extension (59) in a side thereof and to a lower extension (62) provided on the main arm (45), which lower extension (62) comprises a U-shaped wing.

12. A stretchable film tray wrapping machine, as in claim 11, wherein the main arm (45), in moving upwards transporting a larger tray (51'), drives with it the auxiliary arm (55), with the rod (61) housed in a hole or box of a lower extension (62), which rod (61) is driven outwards by action of the electromagnet (60).

* * * * *